US009735461B2

(12) United States Patent
Lo Hine Tong et al.

(10) Patent No.: US 9,735,461 B2
(45) Date of Patent: Aug. 15, 2017

(54) ANTENNA ASSEMBLY FOR ELECTRONIC DEVICE

(71) Applicant: THOMSON LICENSING, Issy de Moulineaux (FR)

(72) Inventors: Dominique Lo Hine Tong, Rennes (FR); Philippe Minard, Saint Medard sur Ille (FR); Jean-Marc Le Foulgoc, Bourgbarre (FR)

(73) Assignee: THOMSON LICENSING, Issy les Moulineaux ( * ) Notice: Subject to any disclaimer, the term of this patent is extended or adjusted under 35 U.S.C. 154(b) by 146 days.

(21) Appl. No.: 14/497,245

(22) Filed: Sep. 25, 2014

(65) Prior Publication Data

US 2015/0091763 A1 Apr. 2, 2015

(30) Foreign Application Priority Data

Sep. 27, 2013 (FR) ..... 13 59327

(51) Int. Cl.
*H01Q 13/10* (2006.01)
*H01Q 1/24* (2006.01)

(52) U.S. Cl.
CPC ..... *H01Q 1/24* (2013.01); *H01Q 1/243* (2013.01); *H01Q 13/10* (2013.01)

(58) Field of Classification Search
CPC ..... H01Q 13/085; H01Q 9/285; H01Q 1/243
USPC ..... 343/702, 767, 789, 872
See application file for complete search history.

(56) References Cited

U.S. PATENT DOCUMENTS

| | | | | |
|---|---|---|---|---|
| 5,194,875 | A * | 3/1993 | Lucas | H01Q 13/085 343/767 |
| 6,282,433 | B1 | 8/2001 | Holshouser | |
| 6,946,996 | B2 | 9/2005 | Koyama | |
| 8,259,021 | B2 | 9/2012 | Pu et al. | |
| 8,350,761 | B2 | 1/2013 | Hill et al. | |
| 8,730,106 | B2 * | 5/2014 | Parsche | H01Q 1/2225 343/700 MS |
| 2006/0001571 | A1 | 1/2006 | Sathath | |
| 2006/0092086 | A1 * | 5/2006 | Franson | H01Q 13/085 343/767 |
| 2009/0073065 | A1 * | 3/2009 | Jordan | H01Q 13/106 343/767 |

(Continued)

FOREIGN PATENT DOCUMENTS

| | | |
|---|---|---|
| CN | 201112561 | 9/2008 |
| EP | 0851530 | 7/1998 |

(Continued)

OTHER PUBLICATIONS

Search Report Dated May 23, 2014.

*Primary Examiner* — Jessica Han
*Assistant Examiner* — Jae Kim
(74) *Attorney, Agent, or Firm* — Brian J. Dorini; Patricia A. Verlangieri

(57) ABSTRACT

An antenna assembly for an electronic device, the antenna assembly comprising a conductive structure for housing at least a circuit board of the electronic device, an antenna formed as a slot in the conductive structure, a feeding element for feeding the antenna by electromagnetic coupling, the feeding element being positioned between the conductive structure and the circuit board and orientated to extend across said slot, the feeding element being connected to a feed line on the circuit board.

8 Claims, 4 Drawing Sheets

(56) References Cited

U.S. PATENT DOCUMENTS

| | | | | |
|---|---|---|---|---|
| 2009/0140937 | A1 | 6/2009 | Chow et al. | |
| 2009/0153411 | A1 | 6/2009 | Chiang et al. | |
| 2009/0256757 | A1* | 10/2009 | Chiang | H01Q 13/10 343/702 |
| 2010/0176997 | A1* | 7/2010 | Ikegaya | H01Q 5/364 343/702 |
| 2011/0300907 | A1* | 12/2011 | Hill | H01Q 9/285 455/566 |
| 2012/0009983 | A1* | 1/2012 | Mow | H01Q 1/243 455/575.7 |
| 2013/0187818 | A1 | 7/2013 | Desclos et al. | |

FOREIGN PATENT DOCUMENTS

| | | |
|---|---|---|
| EP | 1418642 | 5/2004 |
| EP | 1950834 | 7/2008 |
| EP | 1858112 | 7/2010 |
| JP | 9321532 | 12/1997 |
| TW | I258242 | 7/2006 |
| WO | WO2008122831 | 10/2008 |

* cited by examiner

ANTENNA ASSEMBLY FOR ELECTRONIC DEVICE

This application claims the benefit, under 35 U.S.C. §119 of French patent application Ser. No. 1359327, filed Sep. 27, 2013.

FIELD OF THE INVENTION

The present invention relates to an antenna assembly for an electronic device. Particularly but not exclusively the invention relates to an antenna assembly for a wireless electronic device such as an internet gateway, decoder or other network wireless device, or a mobile device such as a "smartphone", tablet or similar device. In an embodiment of the invention a slot-antenna integrated into a mechanical part of an electronic device. The invention further relates to a terminal device or communication apparatus comprising such an antenna assembly.

TECHNICAL BACKGROUND

Communication devices used in networks such as gateway devices for connection to the internet or wireless communication systems are increasingly multi-mode and multi-standard devices. Consequently such devices require the use of several different antennas integrated into the one device. The inclusion of several antennas in a device of reduced dimensions increases the mechanical constraints and performance. Indeed, the antennas should be able to operate in the presence of many mechanical parts and electrical components that may interfere with their radiation performances. Moreover, the location of the antennas in the device is also a challenge. With respect to radiation performance, there is a need to resolve isolation problems between radio frequency systems operating in different frequency ranges. Hence, a low ECC (envelope correlation coefficient) is used in MIMO systems (Multiple Input Multiple Output), the antennas of the MIMO systems being strongly isolated to respond to the maximum capacity of the channel used. Moreover, antenna gain is a key parameter in the performance of wireless systems. In addition, the cost of producing antennas is also an important factor to take into account. The present invention has been devised with the foregoing in mind.

SUMMARY OF THE INVENTION

A first aspect of the invention provides an antenna assembly for an electronic device, the antenna assembly comprising a conductive structure for housing at least a circuit board of the electronic device, an antenna formed as a slot in the conductive structure, a feeding element for feeding the antenna by electromagnetic coupling, the feeding element being positioned between the conductive structure and the circuit board of the electronic device and orientated to cross said slot, the feeding element being connected to a feed line on the printed circuit.

In an embodiment, the slot comprises a first radiating part and a second excitation part extending from the first radiating part, the second excitation part being configured to electromagnetic couple with the feeding element.

In an embodiment, the housing comprises a base plate forming the base of the conductive structure and a side plate forming a front side of the conductive structure, the first radiating part of the slot being formed in the front side of the conductive structure and the second excitation part of the slot being formed in the base plate of the conductive structure.

In an embodiment, the first radiating part has a tapered shape tapering inwards towards the second excitation part. In an embodiment, the second excitation part has a linear shape.

In an embodiment, the feeding element is orientated to extend across the second excitation part of the slot.

In an embodiment, the excitation part of the slot and the feeding element are positioned over corresponding openings in a ground plane of the circuit board.

In an embodiment, the feed element is positioned at a predetermined distance from the conductive structure and the circuit board, respectively.

In an embodiment, the feed element is held in position by a spacer made of insulating material.

In an embodiment, the excitation slot extends from the front side linearly along the base plate.

In an embodiment, the conductive structure forms a ground reference plate for electronic components of the electronic device.

A second aspect of the invention provides an electronic communication device comprising an antenna assembly comprising a circuit board provided with a feed line, a conductive structure for housing the circuit board, an antenna formed as a slot in the conductive structure, a feeding element for feeding the antenna by electromagnetic coupling, the feeding element being positioned between the conductive structure and the circuit board and orientated to extend across said slot, the feeding element being connected to the feed line on the printed circuit.

In an embodiment the printed circuit board comprises a ground plane, the ground plane being provided with openings positioned in alignment with the feeding element and the second excitation part of the slot.

In an embodiment the electronic device is a gateway device or a set top box.

In embodiments of the invention a slot antenna is integrated in conductive material of the housing or ground reference plate of an electronic device. The radiating element is excited from a printed circuit board of the electronic device by using a contact-free interface.

A further aspect of the invention provides an antenna for electronic device comprising at least one housing in a conductive material and a printed circuit board with a ground plane, characterised in that the antenna is formed by a slot realised in said housing in conductive material, the antenna being supplied by electromagnetic coupling using a conductive strip positioned between the housing in conductive material and the printed circuit board so as to cross said slot, the strip being connected to a feeder line realised on the printed circuit and the ground plane having an opening with respect to the slot and the strip.

In an embodiment of the present invention, the strip is held at a predetermined distance, from the housing and the printed circuit board respectively.

In one embodiment, the strip is held in position by a spacer made of insulating material.

In an embodiment, the housing is formed by a first plate with at least one second plate connected to said first plate. The slot is produced in said second plate by extending into said first plate.

A further aspect of the present invention relates to a communication terminal comprising at least one antenna according to any embodiment of the first aspect of the invention.

BRIEF DESCRIPTION OF THE DRAWINGS

Embodiments of the invention will now be described, by way of example only, and with reference to the following drawings in which.

DETAILED DESCRIPTION OF THE INVENTION

An embodiment of the present invention will be described by referring to an electronic device for a domestic network operating in the 2.4 GHz band. It will be appreciated that the invention is not limited to this specific type of device and may be applied to any wireless communication device. In the exemplary electronic device, a metal plate structure may be typically used as shielding and/or as a ground reference plate. The role of this metal plate structure is to obtain the electromagnetic compatibility of the electronic device that includes multiple electronic components, connectors and other circuits. The metal plate structure is used as ground reference for the elements and can reduce interfering signals. Embodiments of the present invention use this metal plate structure to produce a slot-antenna and supply this antenna by means of a contact-free interface.

Figure 1:
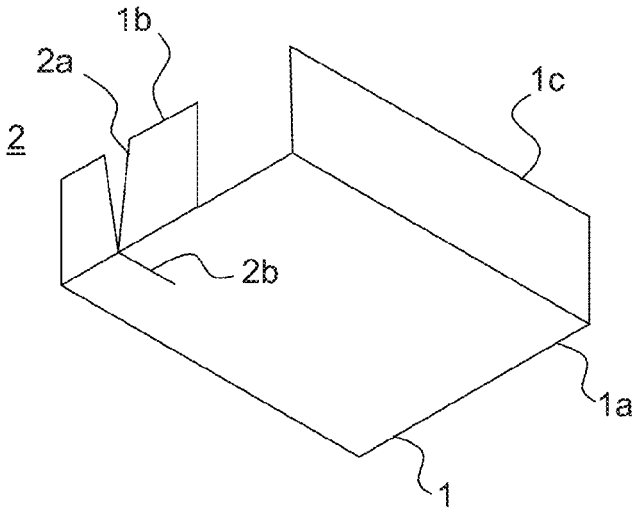
FIG. 1 is a perspective view of a housing fitted with an antenna in accordance with the present invention.

FIG. 1 is a perspective view of a conductive structure 1, forming a housing or ground reference structure for an electronic device in accordance with an embodiment of the invention. The conductive structure 1 is composed of metallic material and comprises a first lower metal plate 1*a*, forming a base plate 1*a*, and side plates 1*b*, 1*c* extending perpendicularly from the base plate 1*a* to form a front plate 1*b* and a side plate 1*c*. The metal plates form an open housing structure 1 in conductive material providing the function of a ground reference plate structure. In some embodiments of the invention the conductive structure acts as shielding. A slot-antenna 2 is formed in the conductive structure 1 and comprises a radiating part 2*a* and an excitation part 2*b*. The radiating part comprises an open slot 2*a* formed in the front plate 1*b*. The open slot 2*a* has a tapered form tapering inwards from the edge of the side plate 1*b* towards the base plate 1*a* and is extended by a linear slot 2*b* in the base plate 1*a*, forming the excitation part 2*b*. The linear slot 2*b* is used to feed the slot antenna 2 by electromagnetic coupling with a feeding strip 4 orientated to extend across the linear slot 2*b*. The linear slot 2*b* terminates in a short-circuit.

Figure 2A:
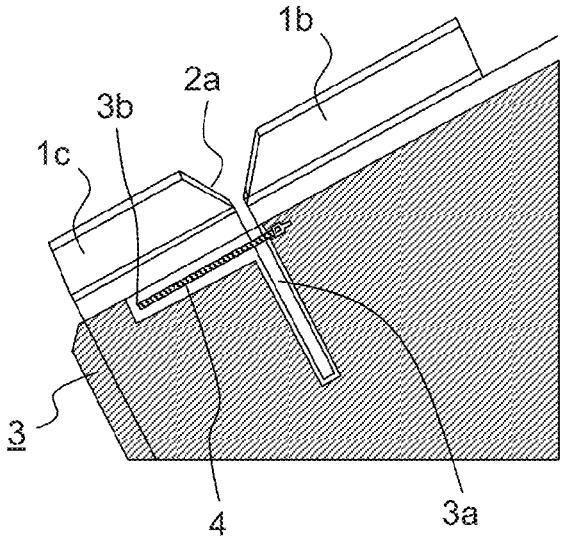
FIG. 2A is a perspective view of an antenna assembly and a printed circuit board in accordance with an embodiment the present invention.
Figure 2B:
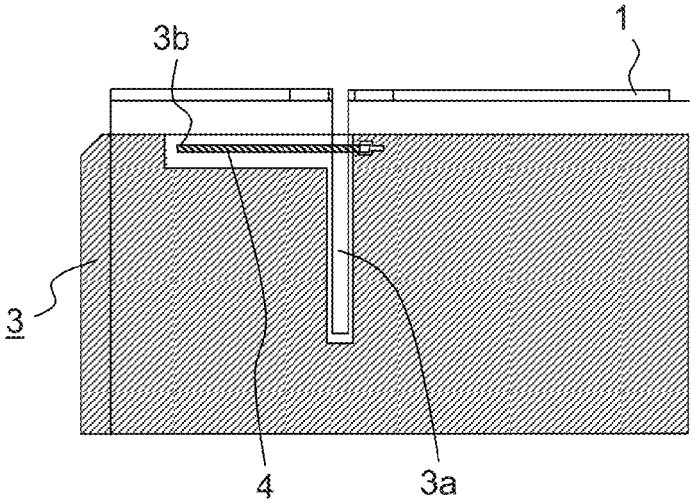
FIG. 2B is a top view of an antenna assembly and a printed circuit board in accordance with an embodiment the present invention.

FIGS. 2A and 2B schematically illustrate an antenna assembly comprising the conductive structure 1 of FIG. 1 and a printed circuit board PCB 3 of an electronic device disposed in the conductive structure 1. The PCB 3 is formed in a known manner, from at least one substrate in a dielectric material, featuring on one face a layer of conductive material forming a ground plane and on the opposite face a layer of conductive material that is printed, for providing a microstrip feed line 3*c*.

The ground plane of the PCB 3 is provided with openings 3*a*, 3*b* located in correspondence respectively with the excitation slot 2*b* and the feeding strip 4.

Figure 3:
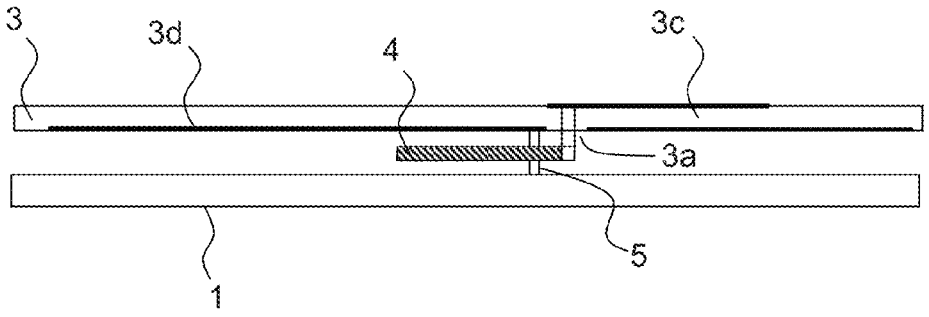
FIG. 3 is a vertical cross-section view of an antenna assembly and a printed circuit board in accordance with an embodiment the present invention FIG. 4 and FIG. 5 graphically illustrate curves as a function of frequency giving the performances obtained by simulating an antenna in accordance with embodiments of the present invention.

FIG. 3 is a schematic side view of the antenna assembly illustrating the elements enabling the supply of the slot-antenna 2 realised in the conductive housing structure 1. Feeding strip 4 is disposed between the PCB 3 and the base plate 1*a* of the conductive housing construction 1. A spacer 5 in insulating material, for example plastic, is mounted between the base plate 1*a* of the conductive housing structure 1 and the printed circuit board 3. In the illustrated embodiment the spacer 5 is provided by an insulating ring around the feeding strip 4. This spacer maintains the required distance between the feeding strip 4 and the base plate 1*a* and the printed circuit board 3, respectively. In the embodiment shown in FIG. 3, the feeding strip 4 has an L-shaped form so as to be positioned perpendicularly to and across the linear slot 2*b* and to pass through a via realised in the printed circuit board 3 for connection to the microstrip feed line 3*c* realised on the upper face of the printed circuit 3 for feeding the antenna 2. The ground plane 3*d* of the printed circuit board 3 has an opening 3*a* realised in the ground plane 3*d* and positioned to correspond to the linear slot 2*b*. Feeding of the slot antenna 2 is provided by electromagnetic coupling between the linear slot 2*b*, acting as an excitation part of the slot antenna 2 and the feeding strip 4 connected to the feed line 3*c*. To do this, the slot 2*b* and the strip 4 have a length equal to around $\lambda/4$ where $\lambda$ is the guided wavelength at the operating frequency of the environment, the value of $\lambda$ depending on the environment and the propagation mode.

The simulation of an antenna in accordance with the described embodiments was realised in the Wi-Fi band of frequency 2.4 GHz. For this simulation the 3D electromagnetic tool HFSS™ (for High Frequency Structural Simulator) was used. The following parameters were taken for the simulation.

Simulation Parameters

| | |
|---|---|
| Printed circuit board or PCB | Substrate = FR4, dielectric constant = DK = 4.4, dissipation factor = Df = 0.02<br>Surface = 114 × 90 mm2<br>Thickness = 0.2 mm<br>width of the impedance microstrip line, characteristic 50 Ohm = 0.36 mm |
| Strip | square cross-section = 0.6 × 0.6 mm2<br>horizontal length of the slot at the open end = 14.5 mm<br>horizontal length of the slot at the vertical point = 2 mm<br>air thickness: strip at the PCB = strip at the plate = 0.6 mm |
| horizontal shielding plate | slot width = 1.5 mm<br>length of the slot of the strip at short-circuit = 16.4 mm<br>length of the slot of the strip in the vertical plane of the antenna = 4 mm |
| Vertical shielding plate | Height = 35 mm<br>Width = 52 mm<br>Distance of the PCB to the vertical plate = 3 mm<br>width of the slot of the open end = 9.75 mm<br>width of the slot of the plate end = 1.5 mm |

-continued

| | |
|---|---|
| Plate thickness | T = 1 mm |
| Grounding | metal posts are added in simulation between the shielding plate and the ground plane of the printed circuit board, providing a common grounding |

Figure 4:
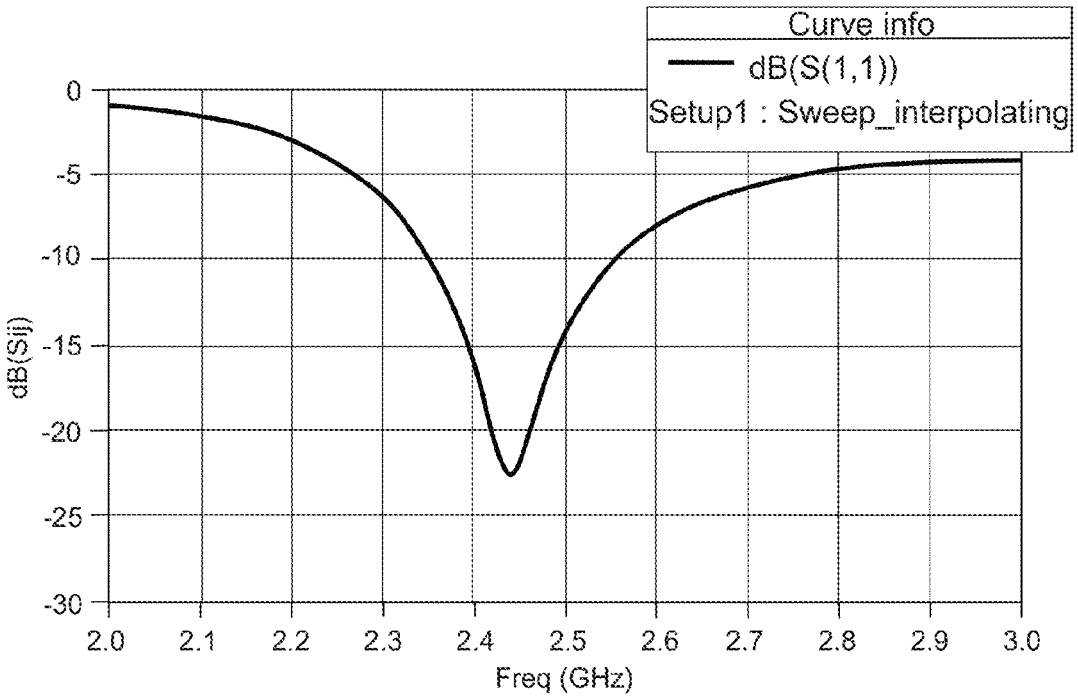
Figure 5:
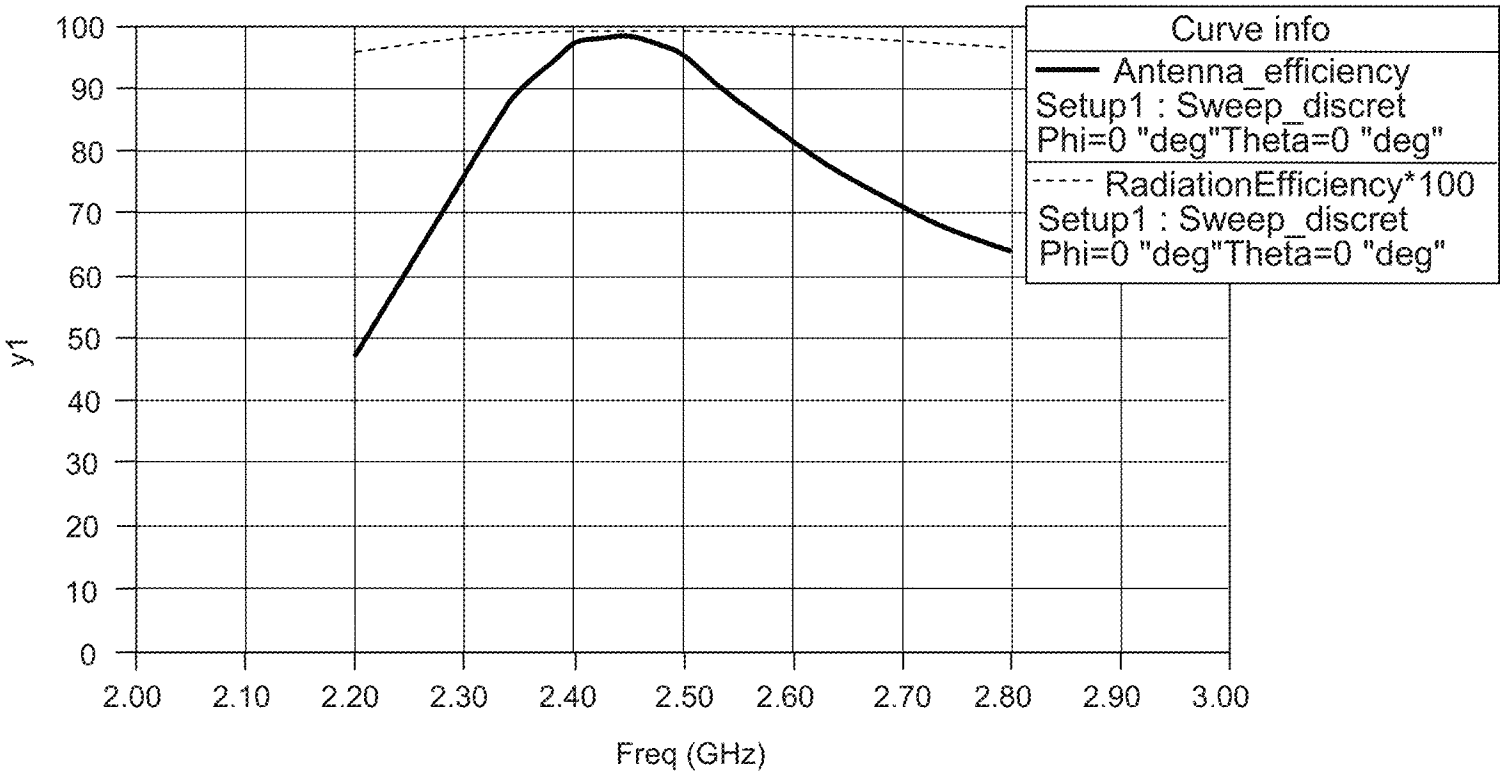

After optimization of the loss level by adding a parallel inductance of value Lp=3.5 nH and a series capacitor of value Cs=2.7 pF in parallel on the input, the results provided in FIGS. 4 and 5 were obtained. FIG. 4 shows the response of the return losses, this curve shows a level of loss close to −15 dB in the frequency band between 2.4 and 2.5 GHz.

Figure 6A:
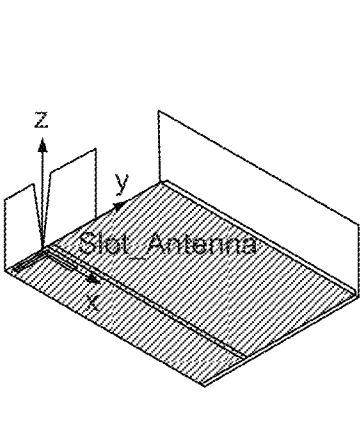
FIG. 6A is a schematic representation of an antenna in accordance with an embodiment the present invention FIGS. 6B and 6C graphically illustrate radiation patterns of the antenna of FIG. 6A.
Figure 6B:
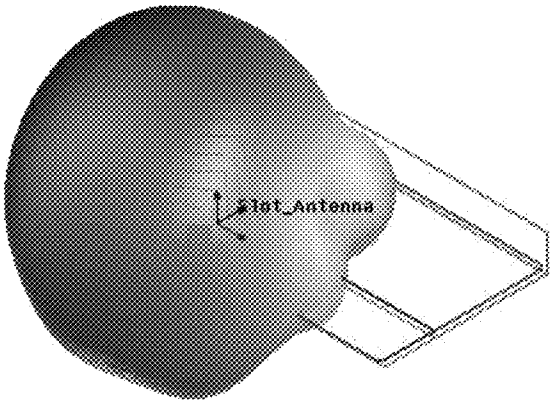
Figure 6C:
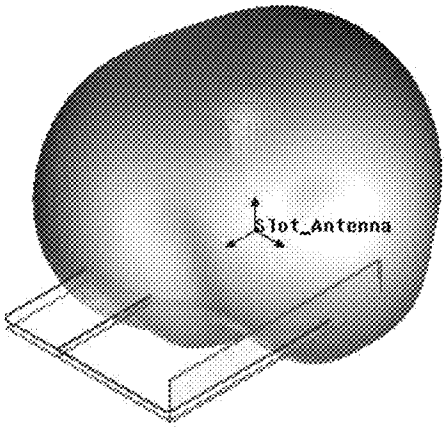

FIG. 5 shows responses for the efficiency of the antenna and efficiency of the radiation as a function of the frequency, respectively. These two curves show an efficiency greater than 95% for the radiation and for the antenna. Moreover in FIG. 6, the radiation patterns of an antenna in accordance with the present invention are shown diagrammatically in 3D. These diagrams show that the slot-antenna in accordance with the invention shown diagrammatically in (A) radiates mainly to the front (B) and on the right-hand side (C) of the electronic device in which the antenna is integrated.

Although the present invention has been described hereinabove with reference to specific embodiments, the present invention is not limited to the specific embodiments, and modifications will be apparent to a skilled person in the art which lie within the scope of the present invention.

For instance, while the foregoing examples have been described with respect to an open slot antenna the antenna may be provided in other shapes.

For example, the antenna may be formed by a closed slot, or by an open slot such as a tapered slot antenna or by a tapered open slot providing a Vivaldi type antenna. The conductive construction used to realise the antenna can be a plate of conductive material other than a ground reference plate or a shielding plate. The conductive feeding strip can have a meandering shape to reduce its size. Likewise, the feed strip and excitation slot can be oriented differently. They should simply cross each other to create an electromagnetic coupling enabling the supply of the antenna. Moreover, in some embodiments of the invention the radiating slot can be realised on the same plane as the excitation slot.

Many further modifications and variations will suggest themselves to those versed in the art upon making reference to the foregoing illustrative embodiments, which are given by way of example only and which are not intended to limit the scope of the invention, that being determined solely by the appended claims. In particular the different features from different embodiments may be interchanged, where appropriate.

The invention claimed is:

1. An antenna assembly for an electronic device, the antenna assembly, comprising:

a conductive structure for housing at least a printed circuit board of the electronic device, the conductive structure including a base plate, a front plate and a side plate, the front plate and side plate extending perpendicularly from the base plate, an antenna including a radiating part formed as a slot in the front plate and an excitation part formed as a linear slot in the base plate connected to and extending from the radiating part where the front and base plate meet, wherein the radiating part has a tapered shape tapering towards the excitation part and divides the front plate, a feeding element for feeding the antenna by electromagnetic coupling, the feeding element being positioned between the base plate and the circuit board, and orientated to extend across said excitation part and wherein the excitation part being configured to electromagnetically couple with the feeding element, the feeding element being connected to a feed line on the circuit board, wherein the printed circuit board lies on the base plate and comrises a ground plane positioned at a predetermined distance from the front plate, the ground plane being provided with openings positioned in alignment with the feeding element and the excitation part of the slot.

2. The antenna assembly according to claim 1, wherein the feeding element is orientated to extend across the excitation part of the slot.

3. The antenna assembly according to claim 1, wherein the excitation part of the slot and the feeding element are positioned over corresponding openings in the ground plane of the circuit board.

4. The antenna assembly according to claim 1, wherein the feed element is positioned at a predetermined distance from the base plate and the circuit board, respectively.

5. The antenna assembly according to claim 1, wherein the feed element is held in position by a spacer made of insulating material.

6. The antenna assembly according to claim 1, wherein the conductive structure forms a ground reference plate for electronic components of the electronic device.

7. An electronic communication device comprising an antenna assembly according to claim 1, and a printed circuit board provided with a feed line for feeding the antenna assembly.

8. The electronic communication device according to claim 7 wherein the electronic device is a gateway device or a set top box.

* * * * *